US007393191B2

(12) United States Patent
Morozumi et al.

(10) Patent No.: US 7,393,191 B2
(45) Date of Patent: Jul. 1, 2008

(54) INTERNAL REFRIGERANT GAS CIRCULATION APPARATUS FOR A CLOSED-TYPE SCROLL COMPRESSOR

(75) Inventors: Naoya Morozumi, Kawasaki (JP); Junya Tanaka, Kawasaki (JP)

(73) Assignee: Fujitsu General Limited, Kawasaki-shi, Kanagawa-ken (JP)

( * ) Notice: Subject to any disclaimer, the term of this patent is extended or adjusted under 35 U.S.C. 154(b) by 0 days.

(21) Appl. No.: 10/798,443

(22) Filed: Mar. 12, 2004

(65) Prior Publication Data

US 2004/0179967 A1 Sep. 16, 2004

(30) Foreign Application Priority Data

Mar. 14, 2003 (JP) ..... 2003-069192

(51) Int. Cl.
*F03C 2/00* (2006.01)
*F04C 2/00* (2006.01)
*F04C 27/02* (2006.01)

(52) U.S. Cl. ..... 418/101; 418/55.1; 418/151

(58) Field of Classification Search ..... 418/55.1–55.6, 418/57, 88, 94, 97, 101, 151; 184/6.16–6.18
See application file for complete search history.

(56) References Cited

U.S. PATENT DOCUMENTS 4,836,755 A * 6/1989 Nitsche et al. ..... 417/368
5,417,554 A * 5/1995 Kietzman et al. ..... 418/101
5,466,134 A * 11/1995 Shaffer et al. ..... 418/101
6,746,215 B2 * 6/2004 Tani et al. ..... 418/55.6

FOREIGN PATENT DOCUMENTS

JP 03067092 A * 3/1991 ..... 418/101
JP 07305688 A * 11/1995
JP 2002308007 A * 10/2002
JP 2003106272 A * 4/2003
JP 2003214372 A * 7/2003
JP 2004143978 A * 5/2004

* cited by examiner

*Primary Examiner*—Theresa Trieu
(74) *Attorney, Agent, or Firm*—Manabu Kanesaka

(57) ABSTRACT

In the case where a radial fan is provided on the upper end side of a rotor to provide an air circulating flow containing refrigerant gas so as not to hinder the flow of lubricating oil in a motor chamber, by which a motor is cooled, in order to reduce the cost of the radial fan, the radial fan is constructed by combining a plurality of blades (fan blades) (242) formed radially in the range of approximately 180° opposed to an upper balancer (270) so as to have a height smaller than the height of the upper balancer (270), and a fan cap (260) including a fan cover portion (262) covering the top faces of the blades (242) and an engagement portion (263) fixed to the upper end side of the rotor.

10 Claims, 11 Drawing Sheets

INTERNAL REFRIGERANT GAS CIRCULATION APPARATUS FOR A CLOSED-TYPE SCROLL COMPRESSOR

THCHINICAL FIELD

The present invention relates to a scroll compressor used for a refrigerating cycle of an air conditioner or the like. More particularly, it relates to a scroll compressor provided with a radial fan that rotates together with a rotor in a closed vessel to restrain heat generation in a motor.

BACKGROUND ART

A scroll compressor has a cylindrical closed vessel whose both ends are closed, and the closed vessel is arranged vertically. In the closed vessel, a refrigerant compressing section consisting of a combination of a fixed scroll and an orbiting scroll and a motor for driving the orbiting scroll are housed. The motor is also a heat source, and when it is operated in a closed space such as the closed vessel, the temperature rises rapidly. An excessive rise in temperature deteriorates component materials of the motor, so that the motor must be cooled.

In the scroll compressor, as one of the methods for preventing an excessive temperature rise of the motor, a method described in Reference 1 (Japanese Patent Application Publication No. H07-305688) is known. This method is explained with reference to FIG. 10. A scroll compressor 1 has a cylindrical closed vessel 2 whose both ends are closed, and the interior of the closed vessel 2 is divided into a compression chamber 21 and a motor chamber 22 with a main frame 4 being held therebetween.

In the compression chamber 21, a refrigerant compressing section 3 consisting of a combination of a fixed scroll 31 and an orbiting scroll 32 is housed, and in the motor chamber 22, a motor 6 having a rotational driving shaft 5 for orbiting the orbiting scroll 32 is housed. The closed vessel 2 is arranged vertically so that the axis thereof is substantially vertical, so that a bottom portion of the closed vessel 2 forms a storage portion for lubricating oil 9.

The fixed scroll 31 and the orbiting scroll 32 each have a scroll wrap formed so as to erect on an end plate, and are arranged in a state in which these scroll wraps are engaged with each other. In this state, the orbiting scroll 32 is rotated by the motor 6, by which a crescent-shaped space formed by the wraps is moved from the outer periphery to the center while the volume is decreased. By utilizing this operation, low-pressure gas is sucked from the outer periphery side and high-pressure gas is discharged from a portion near the center.

In order to restrain an excessive rise in temperature of the motor 6, in Reference 1, a pipe 23 is provided on the outside of the closed vessel 2 to cause the refrigerant compressing section 3 to communicate with a lower space 22*b* of the motor chamber 22, by which high-pressure refrigerant gas produced in the refrigerant compressing section 3 is introduced into the lower space 22*b* of the motor chamber 22 via the pipe 23.

According to this configuration, the high-pressure refrigerant gas passes through a gap Ga between a stator 6*a* and a rotor 6*b* of the motor 6 and a gap Gb between the stator 6*a* and the closed vessel 2, flowing toward an upper space 22*a* of the motor chamber 22 while cooling the motor 6, and is delivered to a refrigerating cycle through a refrigerant discharge pipe 24 provided in the upper space 22*a*.

However, in the case of Reference 1, there arise problems described below. The lubricating oil 9 stored under the motor chamber 22 is pumped up by a positive displacement pump or a centrifugal pump provided on the lower end side of the rotational driving shaft 5 along with the rotation of the rotor 6*b*. After lubricating sliding portions such as a bearing of the main frame 4, the lubricating oil 9 returns from the upper space 22*a* of the motor chamber 22 to the lower space 22*b* thereof passing through the gap between the stator 6*a* and the closed vessel 2.

Therefore, on the outer peripheral side of the stator 6*a*, the high-pressure refrigerant gas flowing from the lower space 22*b* toward the upper space 22*a* and the lubricating oil flowing from the upper space 22*a* toward the lower space 22*b* collide with each other, so that the return of the lubricating oil 9 is hindered. Therefore, a sufficient amount of lubricating oil 9 is not supplied to the pump, so that poor lubrication of sliding portions may occur. Also, since the pipe 23 is laid on the outside of the closed vessel 2, the piping cost is needed.

To solve these problems, the applicant of the present invention has proposed a scroll compressor described in Japanese Patent Application Publication No. 2003-106272 as Reference 2. In this scroll compressor, as communicating means for causing the upper space of motor chamber to communicate with the lower space thereof, first communicating means is provided between the stator of motor and the enclosed vessel, and second communicating means is provided in the rotor of motor or in the rotating shaft thereof. A radial fan that rotates together with the rotor is provided on an upper end ring of the rotor to directly introduce the high-pressure refrigerant gas produced in the refrigerant compressing section into the upper space of the motor chamber, by which the high-pressure refrigerant is circulated by convection using the radial fan to cool the motor.

FIG. 11 shows an example of a radial fan 7 provided on an upper end ring 6*c* of the rotor. According to this configuration, some of high-pressure refrigerant is sucked from the lower space toward the upper space on the second communicating means side, and a circulation path for a flow from the upper space toward the lower space is formed on the first communicating means side, so that the motor can be cooled without a collision of the high-pressure refrigerant gas with the flow of lubricating oil.

In a cage rotor, the end ring is usually manufactured by casting of aluminum. In Reference 2, fan blades 7*a* of the radial fan 7 are formed integrally with the upper end ring 6*c*, and a fan cover 8*a* for covering the top faces of the blades 7*a* is integrally formed on an upper balancer 8 installed to the upper end ring 6*c*.

According to this configuration, by installing the upper balancer 8 to the upper end ring 6*c*, the radial fan 7 can be assembled. However, since the fan blade 7*a* and the upper balancer 8 have the same height, the fan blade 7*a* is higher than is necessary. Also, the mass of the balancer 8 must be increased according to the size of the fan blade 7*a*, which increases the material cost.

Furthermore, since the upper balancer 8 is formed integrally with the fan cover 8*a* for the fan blades 7*a*, and thus the fan cover 8*a* is located just under a bearing section 4*a* (see FIG. 10) of the main frame 4, a space having a height larger than the height of the upper balancer 8 must be secured between the bearing section 4*a* and the rotor 6*b*, which poses a problem in that the axial length of the scroll compressor itself must accordingly be increased inevitably.

To solve this problem, the applicant of the present invention has succeedingly proposed a scroll compressor described in Japanese Patent Application No. 2002-308007 as Reference 3. One example of this proposal is explained with reference to FIG. 12. The height h of the fan blade 7*a* is made have the minimum height necessary for the air blowing capacity of the radial fan 7, while the upper balancer 8 is made have a height p larger than h and is arranged so as to rotate along the outer periphery of the bearing section 4*a* of the main frame 4.

According to this configuration, the space between the bearing section 4*a* and the rotor 6*b* can be made narrower than the height of the upper balancer 8. Therefore, the axial length of the scroll compressor itself can be made shorter, and also the radial fan 7 having a predetermined air blowing capacity can be obtained.

However, in manufacturing the fan blades 7*a* and the upper balancer 8, which have different heights as shown in FIG. 12, sintering is technically difficult to perform. Therefore, a cast product must be finished by cutting, which increases the manufacturing cost. A method can be used in which the radial fan 7 and the upper balancer 8 are manufactured separately by sintering. However, this method is unfavorable because the assembling man power increases, which also results in increased manufacturing cost.

Also, in a synchronous motor using a permanent magnet rotor, unlike an induction motor having the cage rotor, the fan blades cannot be molded integrally with the end ring of rotor. Therefore, the fan blades of radial fan must be manufactured as a piece part by sintering or casting, which causes the cost to increase.

SUMMARY OF THE INVENTION

Accordingly, an object of the present invention is to reduce the cost of a radial fan in the case where in order to prevent an excessive rise in temperature of a motor for driving an orbiting scroll in a refrigerant compressing section, the radial fan is provided on a rotor of the motor to circulate some of refrigerant gas in a motor chamber.

To achieve the above object, a first invention of the present invention provides a scroll compressor in which the interior of a closed vessel is divided into a compression chamber on the upper side, which has a refrigerant compressing section, and a motor chamber on the lower side, which has a motor and is included in a part of a circulating path for refrigerant gas, by a main frame; in the motor chamber, there are provided, as means for causing a motor upper space to communicate with a motor lower space, first communicating means formed on the outer periphery side of a stator of the motor and second communicating means formed on the rotor side of the motor or on the rotor rotating shaft side; and a radial fan and a balancer that rotate together with the rotor are provided on the upper end side of the rotor, so that some of the refrigerant gas is sucked from the motor lower space via the second communicating means, and is discharged into the motor upper space so as to be circulated in the closed vessel by the radial fan, characterized in that the radial fan has a plurality of blades (fan blades) formed radially in the range of approximately 180° opposed to the balancer so as to have a height smaller than the height of the balancer, and a fan cap including a fan cover portion covering the top faces of the blades and an engagement portion fixed to the upper end side of the rotor.

According to this configuration, a fan cover need not be formed integrally with either of the fan blades and the balancer. Therefore, the shapes of these elements may be simple, so that at least the balancer can be manufactured by sintering. Also, since the fan cap is fixed to the upper end side of the rotor together with the balancer, assembly can be accomplished easily.

In order to prevent the refrigerant gas raised through the second communicating means from flowing out into the motor upper space without passing through the radial fan, the fan cap is preferably a partition plate for separating the second communicating means from the motor upper space. Thereby, the second communicating means and the motor upper space are caused to communicate with each other via the blades.

According to a preferred mode of the first invention, the fan cap is formed by one substantially disk-shaped metallic sheet having an insertion hole for the rotor rotating shaft in the center thereof, almost a half of which is used as the fan cover portion and the remaining half of which is used as the engagement portion. According to this configuration, since the fan cap is formed by a product of metallic sheet, the material cost and fabrication cost are significantly lower than those of the conventional molded product.

In order to respond to the case where the heights of the fan blade and the balancer are different from each other, the fan cap preferably has a connecting portion for integrally connecting the fan cover portion and the engagement portion in a step form so that the fan cover portion and the engagement portion are located at positions having different heights.

According to this configuration, in the case where the rotor is a cage rotor, and the blades of the radial fan are formed integrally with an end ring of the cage rotor, while the balancer is formed separately, the engagement portion of the fan cap is fixed to the upper end portion of the rotor together with the balancer in a state of being held between the balancer and the upper end portion of the rotor.

Also, in the case where the rotor is a cage rotor, and both of the blades of the radial fan and the balancer are formed integrally with an end ring of the cage rotor, the engagement portion of the fan cap is fixed to the upper end portion of the rotor together with the balancer in a state of being put on the balancer.

Also, in the case where the rotor is a permanent magnet rotor, and the blades of the radial fan are formed integrally with an end plate installed to the magnet rotor, while the balancer is formed separately, the engagement portion of the fan cap is fixed to the upper end portion of the rotor together with the balancer and the end plate in a state of being held between the balancer and the end plate.

Also, in the case where the rotor is a permanent magnet rotor, and both of the blades of the radial fan and the balancer are formed integrally with an end plate installed to the magnet rotor, the engagement portion of the fan cap is fixed to the upper end portion of the rotor together with the balancer in a state of being put on the balancer.

To further reduce the cost, the first invention embraces a mode in which as the blades of the radial fan, fan blades are used which are formed by bending a metallic sheet, which has an insertion hole for the rotor rotating shaft in the center thereof, into a waveform in the range of approximately 180° in the circumferential direction with the insertion hole being the center.

In this case, an engagement portion which is fixed to the upper end portion of the rotor is provided in the range of remaining 180° of the metallic sheet, and the engagement portion is formed with a split groove which divides the engagement portion into two, in the insertion hole for the rotor rotating shaft. Thereby, the work efficiency for installing the metallic sheet can further be improved.

To achieve the above object, a second invention of the present invention provides a scroll compressor in which the interior of a closed vessel is divided into a compression chamber on the upper side, which has a refrigerant compressing section, and a motor chamber on the lower side, which has a motor and is included in a part of a circulating path for refrigerant gas, by a main frame; in the motor chamber, there are provided, as means for causing a motor upper space to communicate with a motor lower space, first communicating means formed on the outer periphery side of a stator of the motor and second communicating means formed on the rotor side of the motor or on the rotor rotating shaft side; and a radial fan and a balancer that rotate together with the rotor are provided on the upper end side of the rotor, so that some of the refrigerant gas is sucked from the motor lower space via the second communicating means and is discharged into the motor upper space so as to be circulated in the closed vessel by the radial fan, characterized in that the rotor is a permanent magnet rotor having an upper end plate and a lower end plate, and the radial fan consists of grooves formed radially on the lower surface side of the upper end plate so as to communicate with the second communicating means.

According to this configuration, the radial fan can be obtained by simply installing the upper end plate to the rotor. In this case, the balancer can be formed integrally with the upper end plate in the range of approximately 180° opposed to the radial fan to further improve the assembling work efficiency.

To achieve the above object, a third invention of the present invention provides a scroll compressor in which the interior of a closed vessel is divided into a compression chamber on the upper side, which has a refrigerant compressing section, and a motor chamber on the lower side, which has a motor and is included in a part of a circulating path for refrigerant gas, by a main frame; in the motor chamber, there are provided, as means for causing a motor upper space to communicate with a motor lower space, first communicating means formed on the outer periphery side of a stator of the motor and second communicating means formed on the rotor side of the motor or on the rotor rotating shaft side; and a radial fan and a balancer that rotate together with the rotor are provided on the upper end side of the rotor, so that some of the refrigerant gas is sucked from the motor lower space via the second communicating means and is discharged into the motor upper space so as to be circulated in the closed vessel by the radial fan, characterized in that the radial fan is formed by one metallic sheet having an insertion hole for the rotor rotating shaft in the center thereof, and has a fan blade portion including a plurality of radial grooves formed by bending the metallic sheet into a waveform in the range of approximately 180° in the circumferential direction with the insertion hole being the center so as to communicate with the second communicating means and an engagement portion formed so as to be fixed to the upper end side of the rotor together with the balancer in the range of remaining 180°.

According to this configuration, the radial fan can be formed by a metal part produced by fabricating a part of metallic sheet into a waveform without using a sintering or casting process, and also can be assembled to the rotor easily.

DETAILED DESCRIPTION

Figure 1:
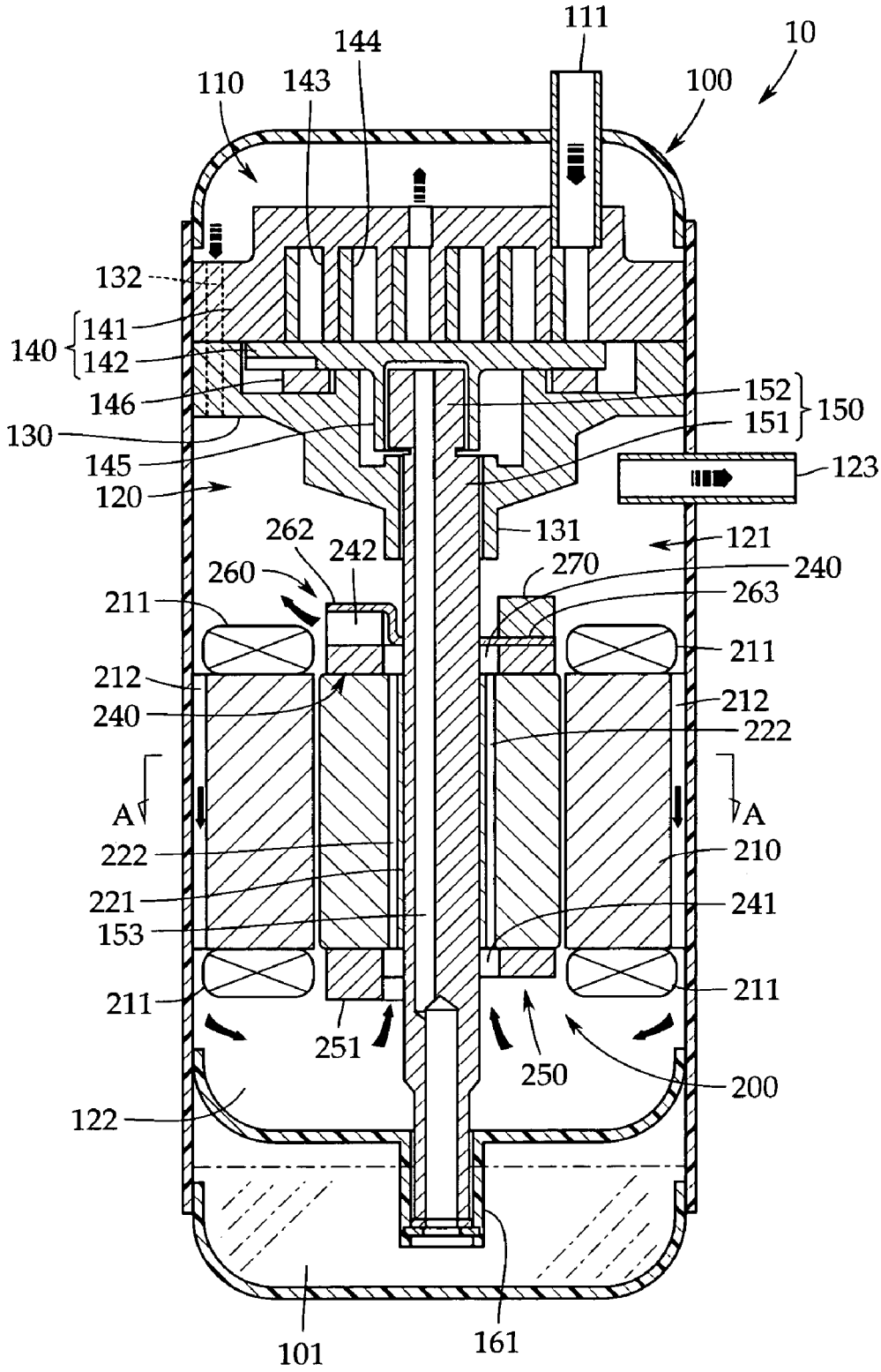
FIG. 1 is a schematic sectional view showing a general configuration of a scroll compressor provided with a rotor in accordance with a first embodiment of the present invention.

A scroll compressor 10 has a cylindrical closed vessel 100 whose both ends are closed and which is arranged vertically. The interior of the closed vessel 100 is divided into a compression chamber 110 on the upper side and a motor chamber 120 on the lower side with a main frame 130 being held therebetween.

In the compression chamber 110, a refrigerant compressing section 140 consisting of a combination of a fixed scroll 141 and an orbiting scroll 142 is housed. On an end plate of the fixed scroll 141, a spiral fixed scroll wrap 143 is erected. Similarly, on an end plate of the orbiting scroll 142, a spiral orbiting scroll wrap 144 is erected. The fixed scroll wrap 143 and the orbiting scroll wrap 144 are engaged with each other.

On the back surface of the orbiting scroll 142, a cylindrical bearing concave portion 145 is provided, and a crankshaft 152 of a motor rotational driving shaft 150 is connected to the bearing concave portion 145. Between the orbiting scroll 142 and a main frame 130, an Oldham's ring 146 is interposed to prevent the orbiting scroll 142 from rotating. Also, a refrigerant suction pipe 111 is inserted in the compression chamber 110 to draw a refrigerant (low-pressure refrigerant) having finished work from, for example, above the closed vessel 100 toward the refrigerant compressing section 140.

In the motor chamber 120, an electric motor (hereinafter referred to as a motor) 200 having a rotational driving shaft 150 for driving the orbiting scroll 142 is housed. The interior of the motor chamber 120 is divided into a motor upper space 121 and a motor lower space 122 by the motor 200, and a bottom portion of the motor lower space 122 forms a storage portion for lubricating oil 101.

The rotational driving shaft 150 includes a rotor rotating shaft 151 installed coaxially to a rotor 220 of the motor 200 and a crankshaft 152 that is provided at the tip end (upper end in FIG. 1) of the rotor rotating shaft 151 so as to be off-centered a predetermined distance with respect to the axis of the rotor rotating shaft 151. In the rotational driving shaft 150, a lubricating oil supply passage 153 is formed eccentrically to conduct the lubricating oil 101 to the tip end of the crankshaft 152.

In the motor lower space 122, there is provided a subframe 160 that pivotally supports the lower end side of the rotor rotating shaft 151. The rotor rotating shaft 151 is supported by two points of a rotor rotation bearing 131 formed on the main frame 130 and a bearing section 161 provided on the subframe 160. The lower end side of the rotor rotating shaft 151 is supported by the subframe 160 so as to be immersed in the lubricating oil 101.

The scroll compressor 10 of this embodiment is of an internal high pressure type. The high-pressure refrigerant gas produced in the refrigerant compressing section 140 once enters the motor upper space 121 of the motor chamber 120 through a gas passage 132 formed on the outer periphery side of the fixed scroll 141 and the main frame 130, and is delivered to a refrigerating cycle, not shown, through a refrigerant discharge pipe 123 provided in the motor upper space 121.

The motor 200 has a stator 210 arranged along the inner peripheral surface of the closed vessel 100 and the rotor 220 arranged rotatably on the inner peripheral surface of the stator 210 with a predetermined gap being provided therebetween. The rotor 220 has the rotor rotating shaft 151 in the center thereof. On the stator 210, a coil 211 is wound to provide a rotating magnetic field to the rotor 220.

The motor upper space 121 and the motor lower space 122 are caused to communicate with each other by two first and second communicating means. In this example, the first communicating means is a notch groove 212 formed on the outer periphery side of the stator 210 between the stator 210 and the closed vessel 100, and the second communicating means is a communicating hole 222 penetratingly formed in the axial direction of the rotor 220. The arrangement and the number of notch holes 212 and communicating holes 222 can be set arbitrarily. The motor upper space 121 and the motor lower space 122 are also caused to communicate with each other by a gap that is present between the stator 210 and the rotor 220.

Figure 2:
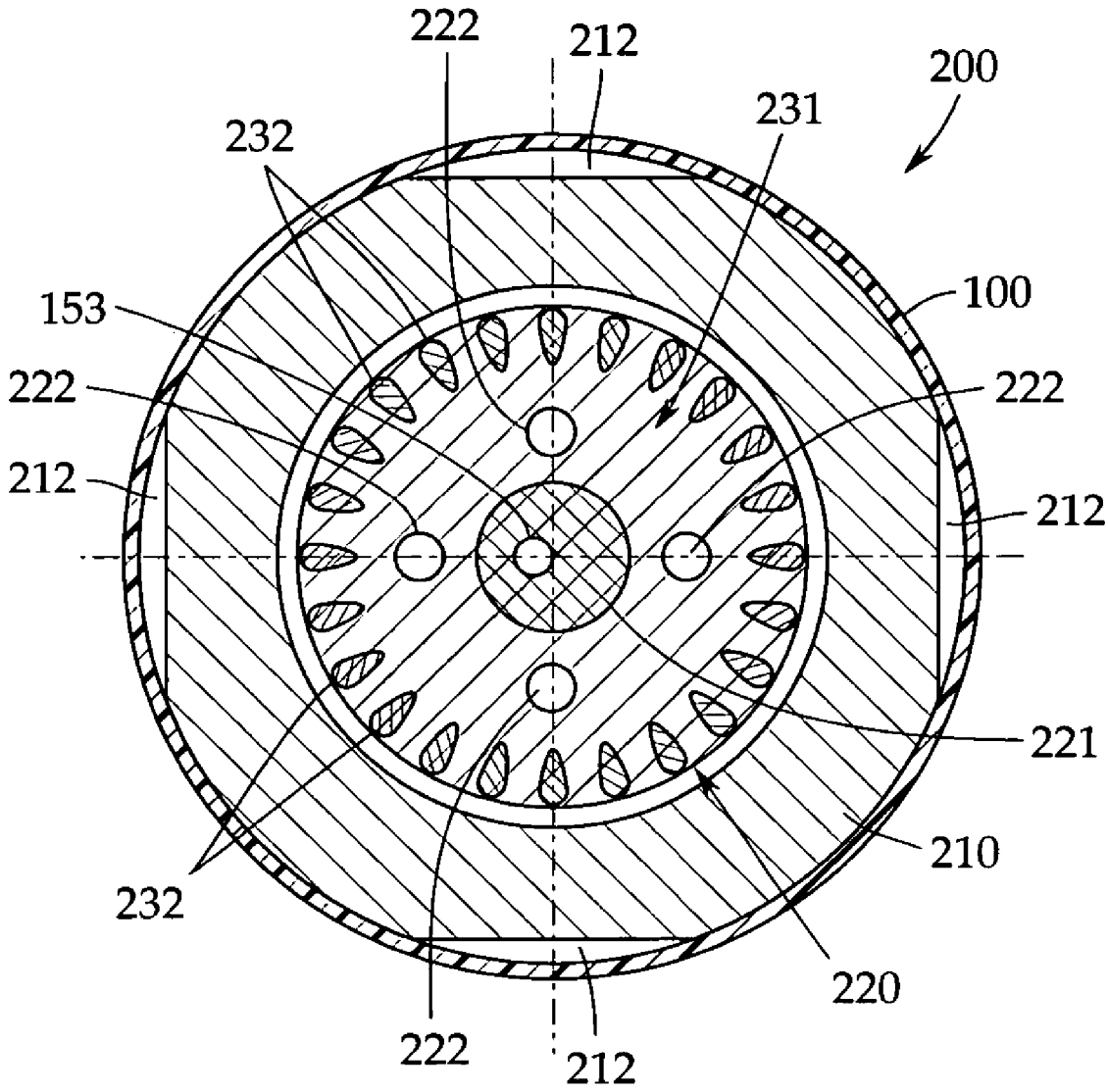
FIG. 2 is a sectional view taken along the line A-A of FIG. 1.

Although the communicating hole 222 is provided in the rotor 220 in FIGS. 1 and 2, it may be provided between a shaft insertion hole 221 in the rotor 220 and the rotor rotating shaft 151. Specifically, a semicircular groove formed on the inner periphery side of the shaft insertion hole 221 and/or the outer periphery side of the rotor rotating shaft 151 may be used as the communicating hole 222.

Figure 3:
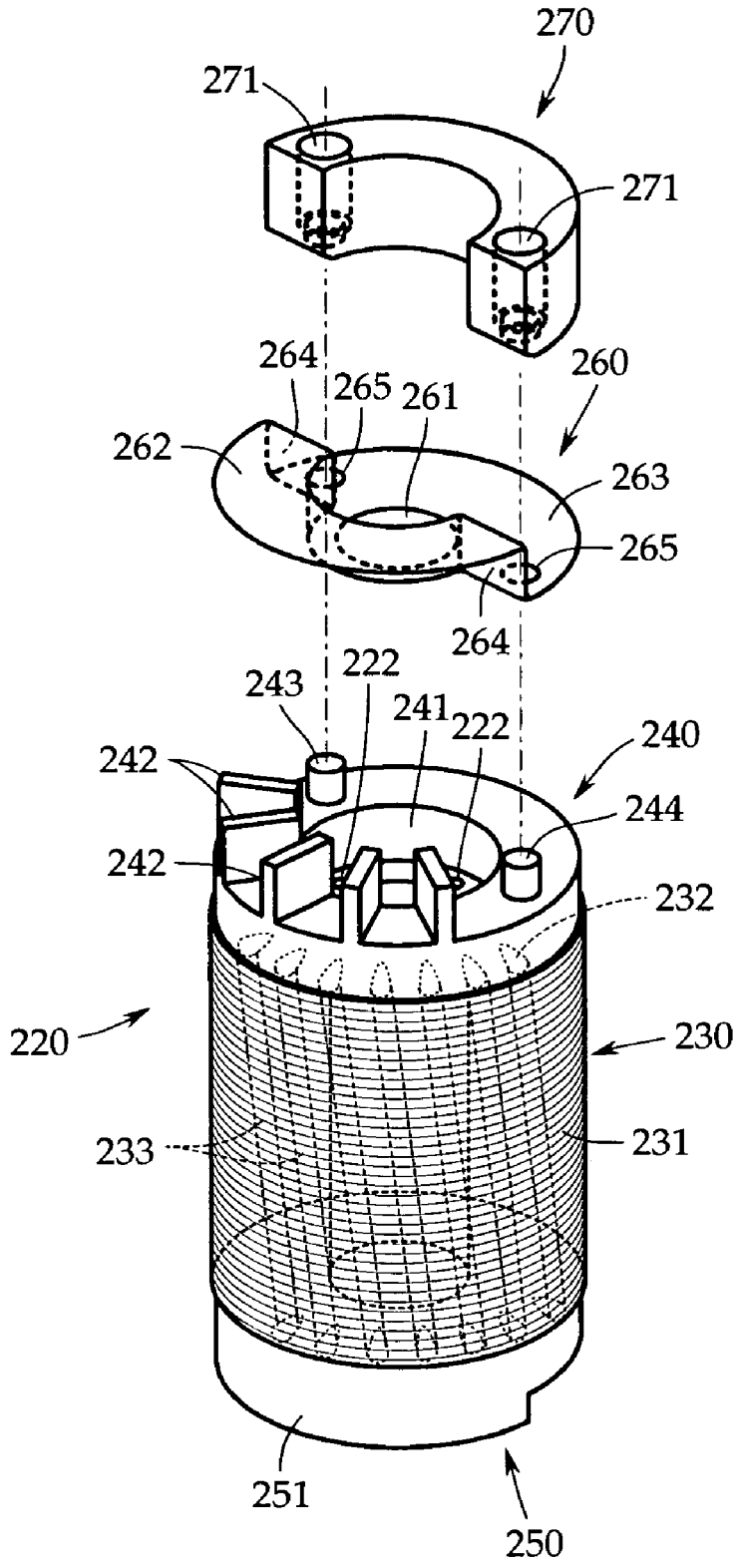
FIG. 3 is an exploded perspective view of the rotor in accordance with the first embodiment.

Next, the construction of the rotor 220 will be described in detail with reference to FIG. 3. The rotor 220 in a first embodiment is a cage rotor. Specifically, the rotor 220 has a rotor body 230 formed by laminating ring-shaped electromagnetic steel sheets 231 while shifting through a predetermined angle, and end rings 240 and 250 are integrally molded at both ends of the rotor body 230.

As shown in FIG. 2, each of the electromagnetic steel sheets 231 is provided with many conductor forming holes 232 for forming cage conductors in the circumferential direction at predetermined intervals. By laminating the conductor forming holes 232 while shifting through a predetermined angle, a cage type slot holes 233 are formed in the rotor body 231.

The end rings 240 and 250 are formed integrally with conductors formed of, for example, aluminum that are cast in the slot holes 233. In the central portion of the end ring 240, 250, a circular concave portion 241 is formed, and each end portion of the communicating hole 222 is arranged in the concave portion 241. The illustration of the circular concave portion on the lower end side is omitted for drawing convenience.

On the upper end ring 240 on the upper side (motor upper space side 121) of the rotor 220, a plurality of fan blades 242 constituting a radial fan are integrally formed. The fan blades 242 are arranged radially over a range of approximately 180° of the upper end ring 240. Also, on the upper end ring 240, guide pins 243 and 244 for fixing a fan cap 260 and a balancer 270, described later, are provided in a pair at an interval of approximately 180°.

The upper end ring 240 is provided with the fan cap 260 and the balancer (upper balancer) 270. The fan cap 260 is formed by one substantially disk-shaped metallic sheet having an insertion hole 261 for the rotor rotating shaft 151 in the center thereof, and has a fan cover portion 262 for covering the top faces of the fan blades 242 and an engagement portion 263 engaged with the upper end ring 240.

The fan cover portion 262 is formed substantially over the semicircumference of the fan cap 260, and the remaining semicircumference forms the engagement portion 263. The fan cover portion 262 and the engagement portion 263 are connected to each other in a step form via connecting portions 264, 264. In this example, the fan cap 260 is formed so that the fan cover portion 262 is located at a position one step higher than the engagement portion 263.

The connecting portion 264, 264 consists of a vertical plate having a height corresponding to the height of the fan blades 242, and both ends thereof are connected to the fan cover portion 262 and the engagement portion 263 substantially at right angles. The engagement portion 263 is formed with guide holes 265, 265 in which the guide pins 243 and 244 of the upper end ring 240 are fitted.

The upper balancer 270 consists of a C-shaped block arranged in the range of approximately 180° on the side opposite to the formation region of the fan blades 242 on the upper end ring 240, and a sintered compact of, for example, brass powder can be used as the upper balancer 270.

The upper balancer 270 is formed so as to be higher than the fan blades 242 so that it has a mass equal to the sum of the balance mass inherent in the scroll compressor and the masses of the fan blades 242. In both end portions of the upper balancer 270 are formed fixing holes 271, 271 into which the guide pins 243 and 244 are inserted from the downside.

The fixing hole 271, 271 is provided as a through hole penetrating the upper balancer 270 from the lower end to the upper end. In this example, the fixing hole 271, 271 is formed so that the hole diameter on the lower end side is approximately equal to the diameter of the guide pin 243, 244 and the hole diameter on the upper end side is larger than that on the lower end side.

In this example, the upper balancer 270 is fixed by being fitted on the guide pins 243 and 244 and then by staking the tip ends of the guide pins 243 and 244 from the upside of the fixing holes 271, 271. For this purpose, the hole diameter on the upper end side is formed so as to be larger. Besides, the upper balancer 270 may be fixed using screw-type fasteners such as bolts.

On the lower end ring 250 on the lower side (motor lower space side 122) the rotor 220, a balancer 251 (hereinafter referred to as a lower balancer) is formed integrally. The lower balancer 251 is formed over a range of approximately 180° of the lower end ring 250, and is formed so as to project by a predetermined height from the lower end surface of the lower end ring 250. The upper balancer 270 and the lower balancer 251 are arranged so as to shift 180° from each other.

According to this configuration, first, the fan cap 260 is placed on the upper end ring 240 so that the fan cover portion 262 covers the top faces of the fan blades 242. For the positioning of the fan cap 260, the guide holes 265, 265 in the engagement portion 263 are fitted on the guide pins 243 and 244 on the upper end ring 240.

Next, the upper balancer 270 is placed on the engagement portion 263 of the fan cap 260 by fitting the fixing holes 271, 271 in the upper balancer 270 on the guide pins 243 and 244, and the tip ends of the guide pins 243 and 244 are staked. Thereby, the radial fan is provided on the rotor 220.

Referring again to FIG. 1, the operation of the scroll compressor provided with the radial fan is explained. When the motor 200 is started to operate the scroll compressor 10, the low-pressure refrigerant that has finished work in the refrigerating cycle, not shown, is introduced to the outer periphery side of the refrigerant compressing section 140 through the refrigerant suction pipe 111, and is compressed while moving between the scroll wraps 143 and 144 of the fixed scroll 141 and the orbiting scroll 142 from the outer periphery side to the center.

The high-pressure refrigerant gas produced by the refrigerant compressing section 140 enters the motor upper space 121 of the motor chamber 120 through the gas passage 132, and is delivered to the refrigerant cycle, not shown, through the refrigerant discharge pipe 123. At this time, in the motor chamber 120, the motor lower space 122 is made to have a negative pressure with respect to the motor upper space 121 by a centrifugal air blowing force of the radial fan consisting of the fan blades 242 that rotate together with the rotor 220.

Therefore, in the notch groove 212, which is the first communicating means, an air flow directed from the motor upper space 121 to the motor lower space 122 is produced, and in the communicating hole 222, which is the second communicating means, an air flow directed from the motor lower space 122 to the motor upper space 121 is produced.

Thereby, some of the high-pressure refrigerant gas that enters the motor upper space 121 is circulated so as to go from the motor upper space 121 to the motor lower space 122 through the notch groove 212 on the outer periphery side and to return from the motor lower space 122 to the motor upper space 121 through the communicating hole 222 on the inner periphery side, by which the motor 200 is cooled.

On the other hand, the lubricating oil 101 stored in the bottom portion of the closed vessel 100 is sucked upward through the lubricating oil supply passage 153 in the rotational driving shaft 150 by pumping means provided at the lower end of the rotational driving shaft 150. After lubricating the bearing sliding portions of the main frame 130, the lubricating oil 101 is returned to the motor upper space 121. The lubricating oil 101 is returned to the bottom portion of the closed vessel 100 rapidly by being carried by the flow of high-pressure refrigerant gas going down through the notch groove 212 on the outer periphery side.

Figure 4:
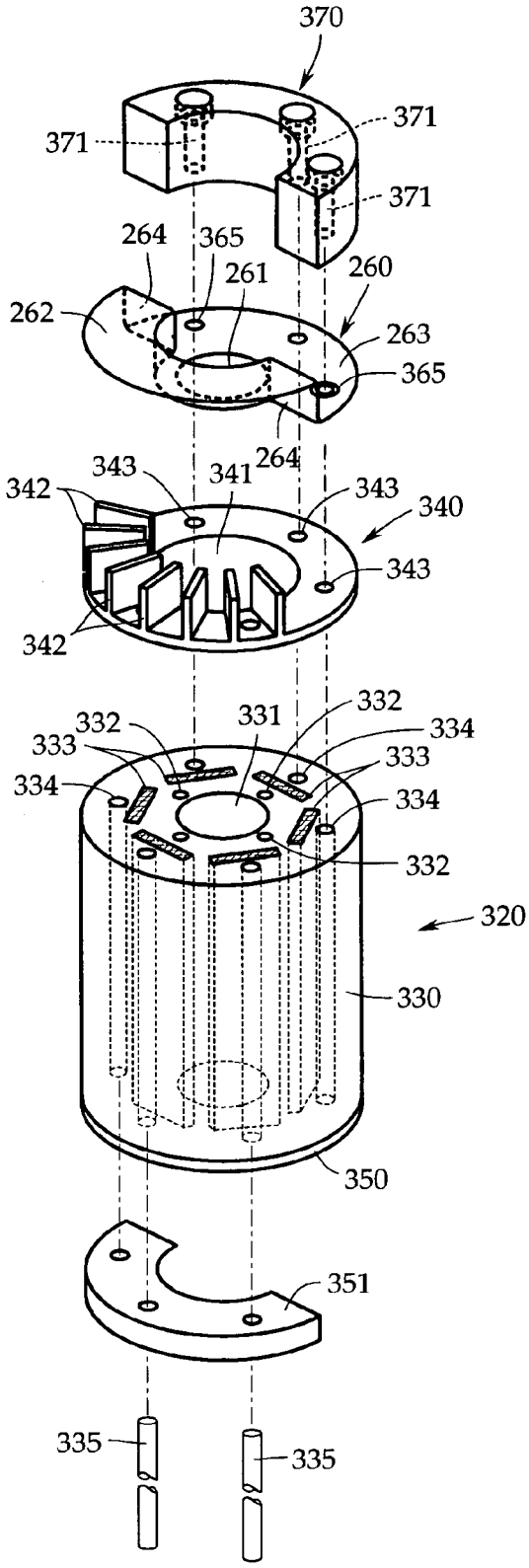
FIG. 4 is an exploded perspective view of a rotor in accordance with a second embodiment of the present invention.

As a second embodiment of the present invention, the fan cap 260 can also be applied to a rotor 320 having permanent magnets of a synchronous motor as shown in FIG. 4. In the permanent magnet rotor (magnet rotor) 320, an upper end plate 340 and a lower end plate 350, which are formed separately from a rotor body 330, are installed on the upper end side and the lower end side of the rotor body 330, respectively.

The upper end plate 340 and the lower end plate 350 correspond to the upper end ring 240 and the lower end ring 250 of the above-described first embodiment, but they are different from each other in that the upper end plate 340 and the lower end plate 350 are not integral with the rotor body 330.

The rotor body 330 consists of a laminated body of electromagnetic steel sheets, and is formed with a shaft insertion hole 331, through which the rotor rotating shaft 151 is inserted, in the center thereof. Around the shaft insertion hole 331, there are provided communicating holes 332 that serve as the second communicating means for causing the motor upper space 121 to communicate with the motor lower space 122 (see FIG. 1). In this example, four communicating holes 332 are provided at intervals of 90° with the axis of the rotor 320 being the center.

Also, in this example, the rotor body 330 is provided with six slot holes arranged at equal intervals in the circumferential direction, and a plate-shaped permanent magnet 333 is inserted in each of the slot holes. On the outer periphery side of the rotor body 330, a plurality of pin insertion holes 334, through which fixing pins 335 for holding the laminated body of electromagnetic steel sheets are inserted, are formed at equal intervals in the circumferential direction.

On the upper end plate 340, a plurality of fan blades 342 for radial fan are erected substantially over the semicircumference thereof. Also, the upper end plate 340 is provided with pin insertion holes 343, through which the fixing pins 335 are inserted, the pin insertion holes 343 being arranged at equal intervals in the circumferential direction. The upper end plate 340 is integrally fixed to the rotor body 330 via the fixing pins 335.

As in the case of the above-described first embodiment, in the magnet rotor 320 as well, on the upper end plate 340, there is provided a substantially C-shaped upper balancer 370 formed of, for example, a sintered compact, the upper balance 370 being arranged in the range of approximately 180° on the side opposite to the formation region of the fan blades 342.

The upper balancer 370 is integrally fixed to the rotor body 330 via the fixing pins 335 together with the fan cap 260 and the upper end plate 340. For this purpose, the engagement portion 263 of the fan cap 260 and the upper balancer 370 are formed with pin insertion holes 365 and 371 through which the fixing pins 335 are inserted.

Like the upper end plate 340, the lower end plate 350 is also integrally fixed to the rotor body 330 via the fixing pins 335. In this example, the lower end plate 350 and a lower balancer 351 are formed separately. The lower balancer 351 is fixed to the rotor body 330 via the fixing pins 335 together with the lower end plate 350. The lower balancer 351 and the lower end plate 350 may be formed so as to be integral.

One example of a procedure for assembling the magnet rotor 320 is explained. Assuming that the permanent magnets 333 are mounted in the rotor body 330 in advance, first, the fixing pins 335 are inserted under pressure into the pin insertion holes 334 in the rotor body 330.

Next, on the upper end side of the rotor body 330, the pin insertion holes 343, 365 and 371 in the upper end plate 340, the fan cap 260, and the upper balancer 370 are fitted on projecting end portions of the fixing pins 335. In this case, as in the case of the above-described first embodiment, the top faces of the fan blades 342 are covered by the fan cover portion 262 of the fan cap 260, and the engagement portion 263 of the fan cap 260 is arranged between the upper end plate 340 and the upper balancer 370.

On the lower end side of the rotor body 330 as well, the lower end plate 350 and the lower balancer 351 are installed to projecting end portions of the fixing pins 335. Then, both ends of the fixing pins 335 are staked. Thus, the radial fan can be assembled to the upper end plate 340 of the magnet rotor 320 at a low cost. The operation of the scroll compressor is the same as that in the above-described first embodiment.

Figure 5:
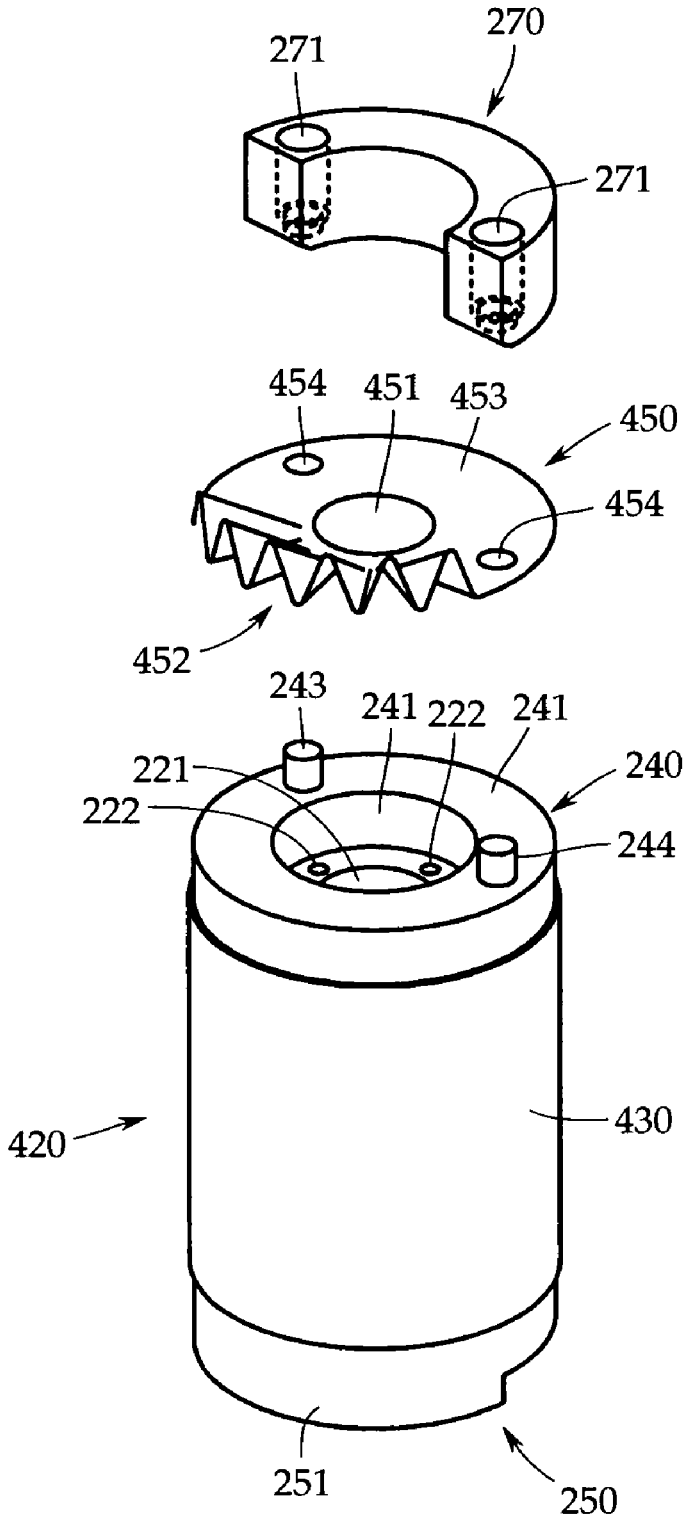
FIG. 5 is an exploded perspective view of a rotor in accordance with a third embodiment of the present invention.

Next, a third embodiment shown in FIG. 5 is explained. FIG. 5 shows a rotor 420 only. This rotor 420 is a rotor for an induction motor, and the basic construction thereof may be the same as that of the rotor 220 shown in FIG. 3, which has been explained in the above-described first embodiment. Therefore, in the rotor 420, the same reference numerals are applied to elements that are the same as or equivalent to those of the rotor 220, and the explanation thereof is omitted.

The third embodiment is characterized by the use of a fan plate 450 having the radial fan. Specifically, in the third embodiment, on the upper end ring 240 of a rotor body 430, there are provided the guide pins 243 and 244 for integrally holding the fan plate 450 and the upper balancer 270.

The fan plate 450 is formed by a ring-shaped metallic sheet having an insertion hole 451 for the rotor rotating shaft 151 in the center thereof, and is provided with a plurality of blades (fan blades) 452 constituting the radial fan. The fan blades 452 are formed by bending the metallic sheet into a waveform in the range of approximately 180° in the circumferential direction with the insertion hole 451 being the center. In the range of remaining 180°, an engagement portion 453 that is fixed to the upper end portion of the rotor body 430 is provided. The engagement portion 453 is provided with a pair of pin insertion holes 454, 454 through which the guide pins 243 and 244 are inserted.

According to this configuration, by fixing the fan plate 450 to the upper end ring 240 of the rotor body 430 together with the upper balancer 270, the radial fan consisting of the fan blades 452 can be obtained. The fan blades 452 communicate with the communicating hole 222 serving as the second communicating means in a state of being fixed to the upper end ring 240. Also, in this embodiment, the fan plate 450 is formed by pressing a metallic sheet. However, it may be formed by a resin sheet.

Figure 6:
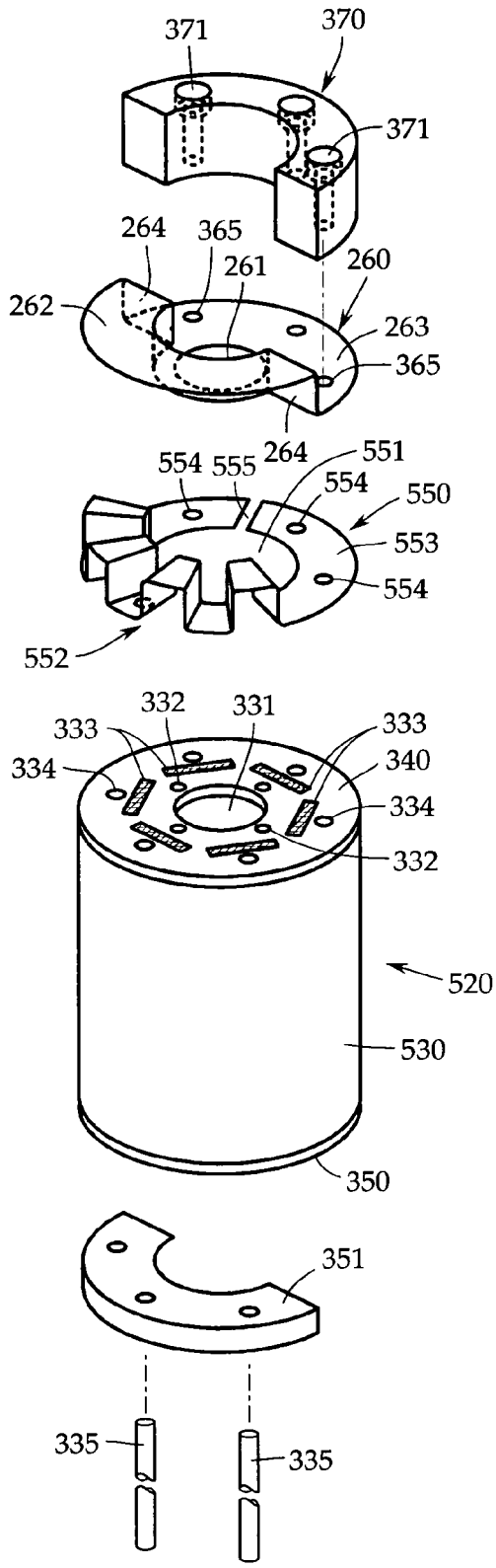
FIG. 6 is an exploded perspective view of a rotor in accordance with a fourth embodiment of the present invention.

Next, a fourth embodiment shown in FIG. 6 is explained. A rotor 520 in the fourth embodiment is a rotor for a permanent magnet motor, and the basic construction thereof may be the same as that of the rotor 320 shown in FIG. 4, which has been explained in the above-described second embodiment. Therefore, in the rotor 520, the same reference numerals are applied to elements that are the same as or equivalent to those of the rotor 320, and the explanation thereof is omitted.

The fourth embodiment is characterized in that fan blades are not formed on the upper end plate 340 of a rotor body 530, and instead a fan plate 550 is used together with the fan cap 260.

The fan plate 550 is formed by pressing a disk-shaped metallic sheet, and is provided with a shaft insertion hole 551, through which the rotor rotating shaft 151 is inserted, in the center thereof. The fan plate 550 is formed with fan blades 552, which are formed by bending the metallic sheet over the range of approximately 180° in the circumferential direction so that vertical faces and horizontal faces are arranged alternately. In the range of remaining 180°, an engagement portion 553 engaging with the upper end plate 340 is formed.

In the engagement portion 553, a plurality of pin insertion holes 554, through which the fixing pins 335 projecting from the rotor body 530 are inserted, are formed at predetermined intervals in the circumferential direction. A part of the engagement portion 553 is formed of a slit groove 555, which gives flexibility to the diameter of the shaft insertion hole 551 to decrease a gap between the shaft insertion hole 551 and the rotor rotating shaft 151 at the time of installation of the fan plate 550, in the radial direction.

The fan cap 260 is put on the fan plate 550. In a state in which the top faces of the fan blades 552 are covered by the fan cover portion 262 of the fan cap 260, the fan plate 550 is fixed to the upper end plate 340 of the rotor body 530 together with the upper balancer 370, and communicates with the communicating holes 332 serving as the second communicating means in a state of being fixed. In some cases, the fan plate 550 may be formed by a resin sheet.

Figure 7:
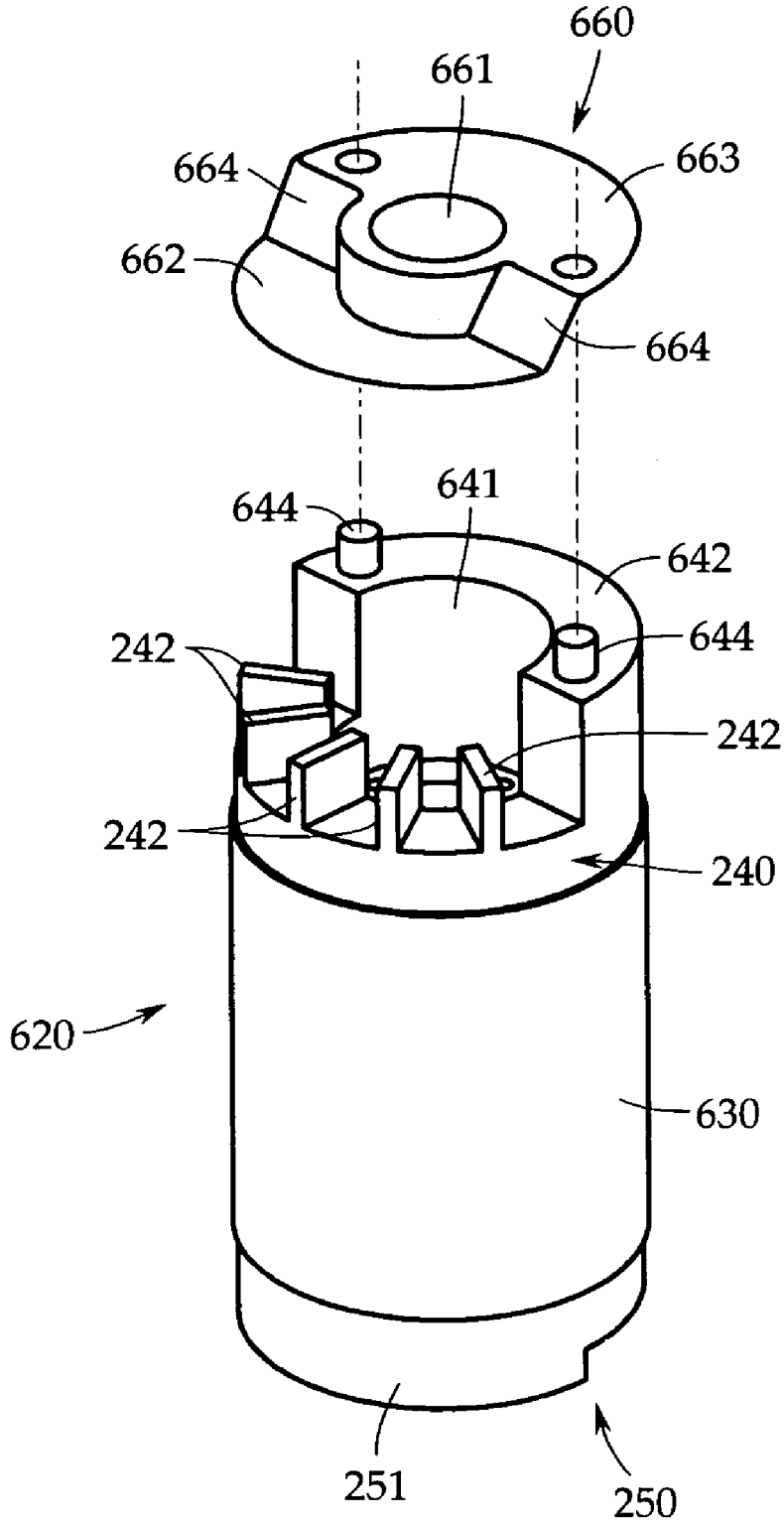
FIG. 7 is an exploded perspective view of a rotor in accordance with a fifth embodiment of the present invention.

Next, a fifth embodiment shown in FIG. 7 is explained. A rotor 620 in the fifth embodiment is a rotor for an induction motor, and the basic construction thereof may be the same as that of the rotor 220 shown in FIG. 3, which has been explained in the above-described first embodiment. Therefore, in the rotor 620, the same reference numerals are applied to elements that are the same as or equivalent to those of the rotor 220, and the explanation thereof is omitted.

The fifth embodiment is characterized in that an upper balancer 642 is formed integrally with the upper end ring 240 of a rotor body 630 together with the fan blades 242, and accordingly a fan cap 660 having a shape different from that of the fan cap 260 is used.

Specifically, on the upper end ring 240, the upper balancer 642, which is arranged in the range of approximately 180° opposed to the fan blades 242, is integrally formed so as to have a height larger than that of the fan blades 242. The upper balancer 642 is provided with guide pins 644, 644 for installing the fan cap 660. The entire mass of the upper balancer 642 is selected so as to be equal to the mass of the upper balancer 270 explained in the above-described first embodiment.

The fan cap 660 is formed preferably by a metallic sheet having a shaft insertion hole 661 through which the rotor rotating shaft 151 is inserted, and has a fan cover portion 662 for covering the top faces of the fan blades 242 and an engagement portion 663 fixed to the upper end portion of the upper balancer 642. The fan cover portion 662 and the engagement portion 663 are connected to each other via step portions 664, 664 so that the fan cover portion 662 is one step lower than the engagement portion 663.

According to the fifth embodiment, by simply fixing the fan cap 660 to the upper balancer 642, the top faces of the fan blades 242 are covered by the fan cover portion 662 of the fan cap 660, by which the radial fan using the fan blades 242 can be obtained.

Figure 8:
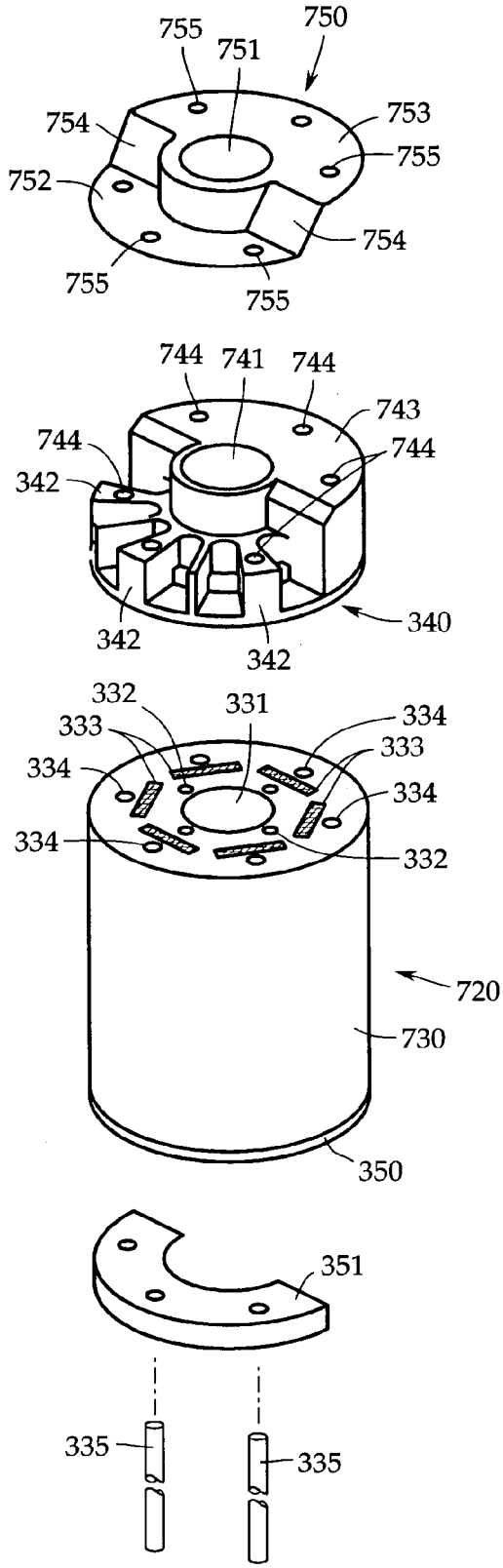
FIG. 8 is an exploded perspective view of a rotor in accordance with a sixth embodiment of the present invention.

Next, a sixth embodiment shown in FIG. 8 is explained. A rotor 720 in the sixth embodiment is a rotor for a permanent magnet motor, and the basic construction thereof may be the same as that of the rotor 320 shown in FIG. 4, which has been explained in the above-described second embodiment. Therefore, in the rotor 720, the same reference numerals are applied to elements that are the same as or equivalent to those of the rotor 320, and the explanation thereof is omitted.

The sixth embodiment is characterized in that an upper balancer 743 is formed integrally with the upper end plate 340 installed to a rotor body 730 together with the fan blades 342, and accordingly a fan cap 750 having the same shape as that of the fan cap 660 in the above-described fifth embodiment is used.

Specifically, the upper end plate 340 has a shaft insertion hole 741 through which the rotor rotating shaft 151 is inserted, and the upper balancer 743, which is arranged in the range of approximately 180° opposed to the fan blades 342, is integrally formed so as to have a height larger than that of the fan blades 342. The entire mass of the upper balancer 743 is selected so as to be equal to the mass of the upper balancer 370 explained in the above-described second embodiment.

The fan blades 342 and the upper balancer 743 are formed with pin insertion holes 744, through which the end portions of the fixing pins 335 inserted under pressure in the rotor body 730 are inserted, at predetermined intervals to fix the upper end plate 340 to the rotor body 730.

The fan cap 750 is substantially the same as the fan cap 660. It is formed preferably by a metallic sheet having a shaft insertion hole 751 through which the rotor rotating shaft 151 is inserted, and has a fan cover portion 752 for covering the top faces of the fan blades 342 and an engagement portion 753 fixed to the upper end portion of the upper balancer 743.

The fan cover portion 752 and the engagement portion 753 are connected to each other via step portions 754, 754 so that the fan cover portion 752 is one step lower than the engagement portion 753. Also, the fan cover portion 752 and the engagement portion 753 are formed with pin insertion holes 755 at positions corresponding to the pin insertion holes 744 in the upper end plate 340 to fix the fan cap 750 to the rotor body 730.

In the sixth embodiment as well, after the upper end plate 340 is installed to the rotor body 730, by simply fixing the fan cap 750 to the upper end plate 340, the top faces of the fan blades 342 are covered by the fan cover portion 752 of the fan cap 750, by which the radial fan using the fan blades 342 can be obtained.

Figure 9:
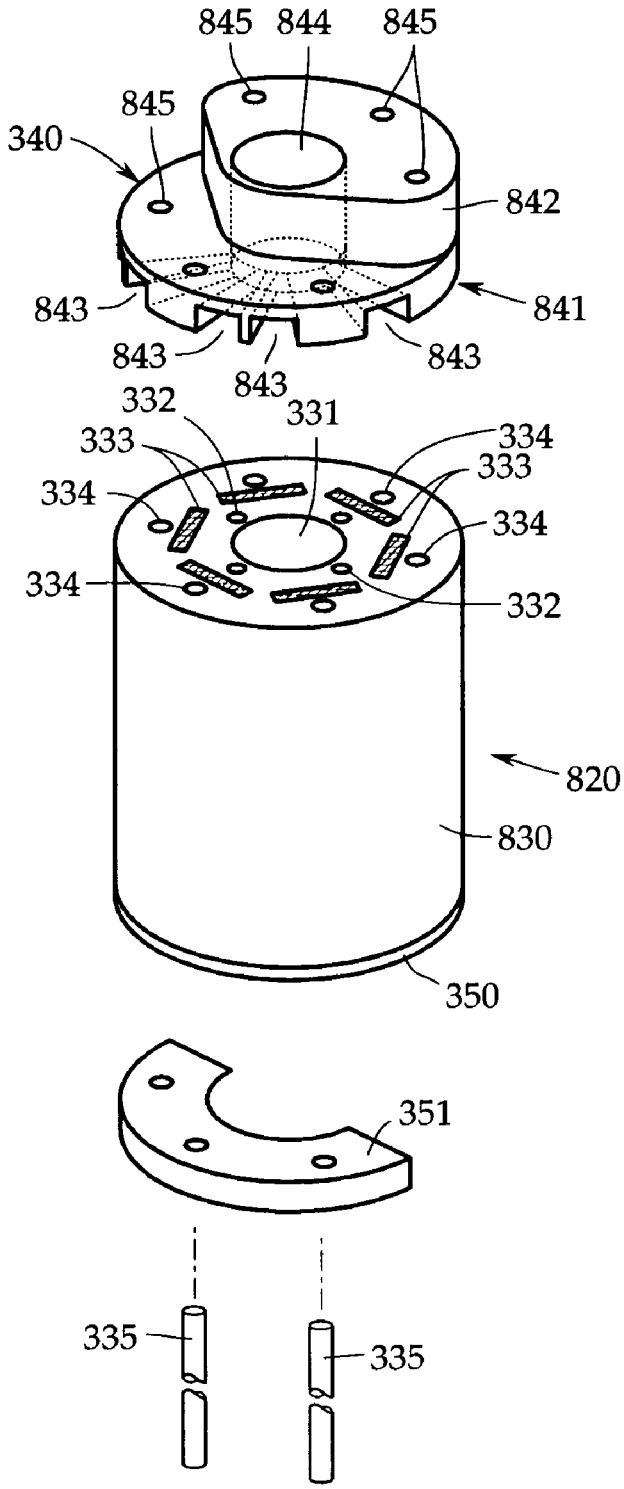
FIG. 9 is an exploded perspective view of a rotor in accordance with a seventh embodiment of the present invention.
Figure 10:
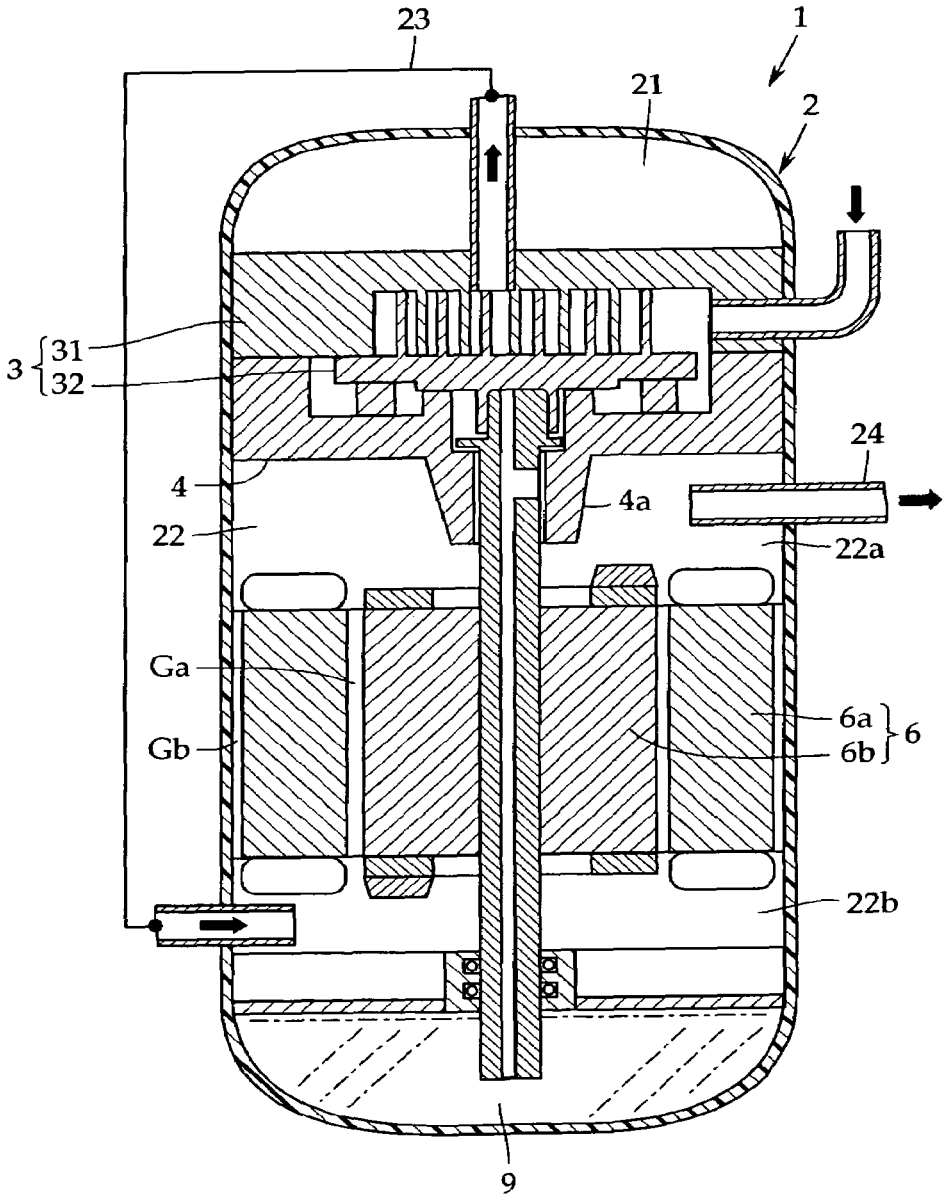
FIG. 10 Prior Art
FIG. 10 is a schematic sectional view of a scroll compressor of a first conventional example.
Figure 11:
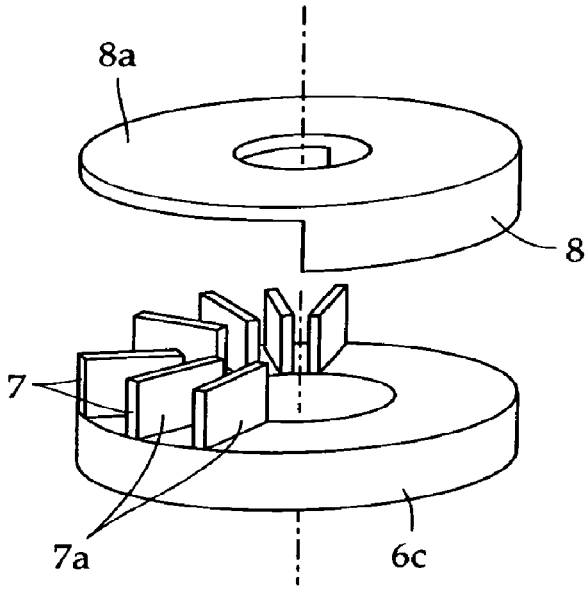
FIG. 11 Prior Art
FIG. 11 is an exploded perspective view showing a construction of a radial fan provided by a scroll compressor of a second conventional example.
Figure 12:
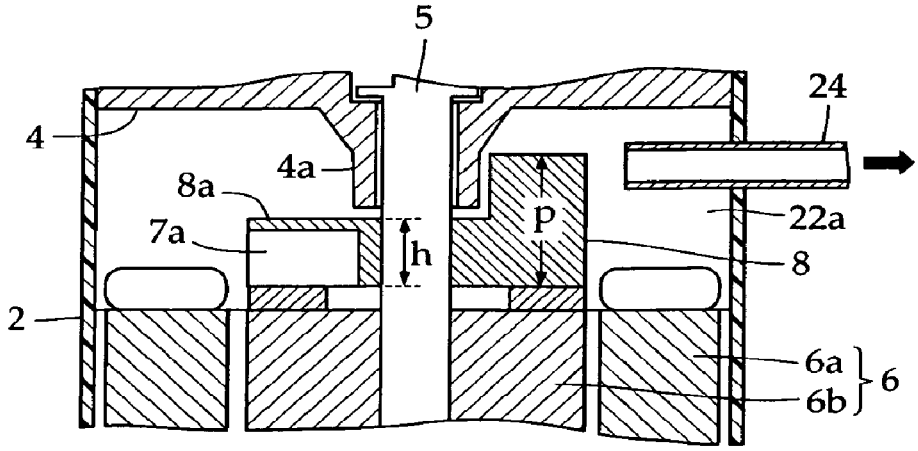
FIG. 12 Prior Art
FIG. 12 is schematic sectional view showing a construction of a radial fan provided by a scroll compressor of a third conventional example.

Next, a seventh embodiment shown in FIG. 9 is explained. A rotor 820 in the seventh embodiment is a rotor for a permanent magnet motor, and corresponds to a modification of the above-described sixth embodiment. Therefore, in the rotor 820, the same reference numerals are applied to elements that are the same as or equivalent to those of the rotor 720, and the explanation thereof is omitted.

The seventh embodiment is characterized in that the radial fan is provided on the lower surface side (the surface side opposed to a rotor body 830) of the upper end plate 340 installed to the rotor body 830.

Specifically, the upper end plate 340 is formed into a disk shape having a shaft insertion hole 844, through which the rotor rotating shaft 151 is inserted, in the center thereof preferably by sintering of metal powder. The upper end plate 340 is formed so as to have a large thickness, and on the lower surface side opposed to the rotor body 830, a plurality of grooves 843 for radial fan are formed radially in the range of approximately 180°. The grooves 843 communicate with the communicating holes 332 serving as the second communicating means when the upper end plate 340 is fixed to the rotor body 830.

Also, on the upper surface side of the upper end plate 340, an upper balancer 842 is provided in the range of approximately 180° on the opposite side opposed to the grooves 843 for radial fan. The upper balancer 842 is preferably formed integrally with the upper end plate 340, but it may be formed separately and may be installed on the top surface of the upper end plate 340.

The upper end plate 340 is formed with pin insertion holes 845, through which the end portions of the fixing pins 335 inserted under pressure in the rotor body 830 are inserted, at predetermined intervals to fix the upper end plate 340 to the rotor body 830.

According to the seventh embodiment, since the radial fan can be obtained by simply fixing the upper end plate 340 to the rotor body 830, the aforementioned balancer cap is not needed, and thus the cost of radial fan can be reduced.

Although the scroll compressor explained in the above-described embodiments is of an internal high pressure type in which the high-pressure refrigerant gas produced in the refrigerant compressing section is supplied to the refrigerating cycle via the motor chamber, the present invention can be applied to an internal low pressure type in which the low-pressure refrigerant returned from the refrigerating cycle is given to the refrigerant compressing section via the motor chamber. Also, although the balancer, the fan cap, and the like are fixed by staking the pins in the above embodiments, they may be fixed by using other fixing means such as bolts.

The above is a description of preferred embodiments of the present invention given with reference to the accompanying drawings. The present invention is not limited to these embodiments. Various changes and modifications that will occur to a person skilled in the art having the ordinary technical knowledge who is engaged in the field of the scroll compressor within the scope of technical concept described in the appended claims are naturally embraced in the technical scope of the present invention.

The invention claimed is:

1. A scroll compressor in which an interior of a closed vessel is divided into a compression chamber on an upper side, which has a refrigerant compressing section, and a motor chamber on a lower side, which has a motor and is included in a part of a circulating path for refrigerant gas, by a main frame; in said motor chamber, there are provided, as means for causing a motor upper space to communicate with a motor lower space, first communicating means formed on an outer periphery side of a stator of said motor and second communicating means formed on a rotor side of said motor or on a rotor rotating shaft side; and a radial fan and a balancer that rotate together with said rotor are provided on an upper end side of said rotor, so that some of said refrigerant gas is sucked from said motor lower space via said second communicating means, and is discharged into said motor upper space so as to be circulated in said closed vessel by said radial fan, wherein said radial fan has a plurality of blades formed radially in a range of approximately 180° opposed to said balancer so as to have a height smaller than a height of said balancer, and a fan cap including a fan cover portion covering top faces of said blades and an engagement portion fixed to the upper end side of said rotor.

2. The scroll compressor according to claim 1, wherein said fan cap is arranged above said second communicating means, and said second communicating means communicates with said motor upper space via the blades.

3. The scroll compressor according to claim 1, wherein said fan cap is formed by one substantially disk-shaped metallic sheet having an insertion hole for said rotor rotating shaft in a center thereof, almost a half of which is used as said fan cover portion and a remaining half of which is used as said engagement portion.

4. The scroll compressor according to claim 1, wherein said fan cap has a connecting portion for integrally connecting said fan cover portion and said engagement portion in a step form so that said fan cover portion and said engagement portion are located at positions having different heights.

5. The scroll compressor according to claim 1, wherein in a case where said rotor is a cage rotor, and the blades of said radial fan are formed integrally with an end ring of said cage rotor, while said balancer is formed separately, the engagement portion of said fan cap is fixed to an upper end portion of said rotor together with said balancer in a state of being held between said balancer and the upper end portion of said rotor.

6. The scroll compressor according to claim 1, wherein in a case where said rotor is a cage rotor, and both of the blades of said radial fan and said balancer are formed integrally with an end ring of said cage rotor, the engagement portion of said fan cap is fixed to an upper end portion of said balancer in a state of being put on said balancer.

7. The scroll compressor according to claim 1, wherein in a case where said rotor is a permanent magnet rotor, and the blades of said radial fan are formed integrally with an end plate installed to said magnet rotor, while said balancer is formed separately, the engagement portion of said fan cap is fixed to an upper end portion of said rotor together with said balancer and said end plate in a state of being held between said balancer and said end plate.

8. The scroll compressor according to claim 1, wherein in a case where said rotor is a permanent magnet rotor, and both of the blades of said radial fan and said balancer are formed integrally with an end plate installed to said magnet rotor, the engagement portion of said fan cap is fixed to an upper end portion of said balancer in a state of being put on said balancer.

9. The scroll compressor according to claim 1, wherein the blades of said radial fan comprises fan blades formed by bending a metallic sheet, which has an insertion hole for said rotor rotating shaft in a center thereof, into a waveform in a range of approximately 180° in a circumferential direction with said insertion hole being the center.

10. The scroll compressor according to claim 9, wherein the engagement portion which is fixed to an upper end portion of said rotor is provided in a range of remaining 180° of said metallic sheet, and said engagement portion is formed with a split groove which divides said engagement portion into two.

* * * * *